US009126789B2

(12) United States Patent
Hori et al.

(10) Patent No.: US 9,126,789 B2
(45) Date of Patent: Sep. 8, 2015

(54) IMAGE FORMING APPARATUS

(71) Applicant: CANON KABUSHIKI KAISHA, Tokyo (JP)

(72) Inventors: Hirofumi Hori, Numazu (JP); Ryuji Hamasaki, Zhongshan (CN); Shunsuke Okazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/332,710

(22) Filed: Jul. 16, 2014

(65) Prior Publication Data

US 2015/0021847 A1 Jan. 22, 2015

(30) Foreign Application Priority Data

Jul. 22, 2013 (JP) ..... 2013-151521

(51) Int. Cl.

| | |
|---|---|
| ***B65H 1/26*** | (2006.01) |
| ***B65H 3/44*** | (2006.01) |
| ***B65H 1/28*** | (2006.01) |
| ***B65H 7/02*** | (2006.01) |

(52) U.S. Cl.

CPC ..... *B65H 1/28* (2013.01); *B65H 1/266* (2013.01); *B65H 3/44* (2013.01); *B65H 7/02* (2013.01); *B65H 2405/332* (2013.01); *B65H 2511/20* (2013.01); *B65H 2511/515* (2013.01); *B65H 2601/321* (2013.01); *B65H 2601/324* (2013.01)

(58) Field of Classification Search

CPC ..... B65H 1/266; B65H 3/44; B65H 39/042; B65H 2405/332; B65H 2601/321; B65H 2601/324; B65H 2511/515

USPC ..... 271/9.11, 9.01, 9.02

See application file for complete search history.

(56) References Cited

U.S. PATENT DOCUMENTS

| | | | | |
|---|---|---|---|---|
| 4,958,822 | A * | 9/1990 | Rutishauser et al. | 271/9.11 |
| 4,966,356 | A * | 10/1990 | Ohyabu et al. | 271/9.11 |
| 5,155,537 | A * | 10/1992 | Komatsu et al. | 399/391 |
| 7,967,287 | B2 | 6/2011 | Hamasaki et al. | |
| 8,020,848 | B2 * | 9/2011 | Kita et al. | 271/9.03 |
| 8,235,376 | B2 * | 8/2012 | Blair et al. | 271/9.11 |
| 8,302,956 | B2 | 11/2012 | Matsushima et al. | |
| 8,424,863 | B2 * | 4/2013 | Kita et al. | 271/9.03 |
| 8,556,253 | B2 | 10/2013 | Okazaki | |
| 8,714,543 | B2 | 5/2014 | Matsushima et al. | |
| 2011/0241285 | A1 * | 10/2011 | Sekiguchi | 271/162 |
| 2013/0009359 | A1 * | 1/2013 | Yamada | 271/264 |
| 2013/0113157 | A1 * | 5/2013 | Fujita | 271/126 |
| 2014/0021680 | A1 | 1/2014 | Hamasaki | |

FOREIGN PATENT DOCUMENTS

| | | | |
|---|---|---|---|
| JP | 2000-264485 | A | 9/2000 |
| JP | 2004-256287 | A | 9/2004 |

* cited by examiner

*Primary Examiner* — Patrick Cicchino

(74) *Attorney, Agent, or Firm* — Fitzpatrick, Cella, Harper & Scinto

(57) ABSTRACT

The present invention provides an image forming apparatus that can facilitate a replacement of a sheet feeding portion.

When a detecting portion detects that a sheet feeding cassette is mounted, a controller controls a driving portion in such a manner as to lift a sheet supporting plate for the mounted sheet feeding cassette. When the detecting portion detects that a sheet feeding cassette is mounted, the controller controls a driving portion in such a manner as not to lift a sheet supporting plate for the mounted sheet feeding cassette in the case where it is determined that a sheet feeding cassette nearest a feeding roller of the mounted sheet feeding cassette is drawn or detached.

25 Claims, 7 Drawing Sheets

IMAGE FORMING APPARATUS

BACKGROUND OF THE INVENTION

1. Field of the Invention

The present invention relates to an image forming apparatus and, more particularly, to the replacement of a sheet feeding (supplying) unit in the case where a plurality of sheet storage units is provided in a main body of an image forming apparatus.

2. Description of Related Art

In some of conventional image forming apparatuses such as a copying machine and a printer, a plurality of sheet storage units is superposed at the lower section of a main body of an image forming apparatus or is arranged in a lateral direction, so that the number of sheets that can be fed is increased, and further, sheets having different sizes can be used.

A sheet feeding cassette serving as a sheet storage unit is provided with a sheet supporting plate serving as a sheet stacking member that can be moved in a vertical direction in which a sheet is stacked. Moreover, on the side of the main body of the image forming apparatus are provided a lifting and lowering mechanism for lifting and lowering the sheet supporting plate and a feeding roller constituting a sheet feeding unit for feeding the sheet stacked on the sheet feeding cassette.

When the sheet feeding cassette is installed in the main body of the image forming apparatus, the lifting and lowering mechanism lifts the sheet supporting plate, and thus, the sheet stacked on the sheet supporting plate is moved to a position at which the sheet can be supplied/fed by the feeding roller. Thereafter, when one out of the plurality of sheet feeding cassettes is selected, the sheet stacked on the selected sheet feeding cassette is supplied/fed by the feeding roller located above the selected sheet feeding cassette.

In the meantime, if the feeding roller is degraded due to abrasion or the like in the conventional image forming apparatus, sheet feeding performance is deteriorated. Therefore, the feeding roller need be replaced with a new one periodically or in much abrasion amount. At this time, in order to facilitate the replacement of the feeding roller, the feeding roller has been detachably attached to the main body of the image forming apparatus in the related art (see Japanese Patent Laid-Open No. 2004-256287). Alternatively, the feeding roller has been replaced by using a roller replacing tool (see Japanese Patent Laid-Open No. 2000-264485).

Here, in the case where the feeding roller is configured in a detachably attachable manner, the sheet feeding cassette need be detached, and then, the feeding roller need be replaced, since the feeding roller is disposed above the sheet feeding cassette. However, in the case where the feeding roller is located at the lower section of the main body of the image forming apparatus, the feeding roller cannot be visually recognized even if the sheet feeding cassette is detached. In this case, a replacement section is peeped through a clearance produced by detaching the sheet feeding cassette, and further, a hand need be inserted through the clearance, followed by replacement of the feeding roller.

On the other hand, in the case where the feeding roller is located at the lower section of the main body of the image forming apparatus, a worker need work with his/her eyes under his/her waist, resulting in poor workability. Moreover, there is a possibility that the sheet feeding cassette may not be detached in the case where the sheet feeding cassette has a large capacity. In this case, a worker need work in the state in which the sheet feeding cassette is kept drawn, so that it becomes more difficult to replace the feeding roller because of the hindrance of the large-capacity cassette to the standing position of a worker.

The present invention has been accomplished in view of the above-described current circumstances. Therefore, it is desirable to provide an image forming apparatus, in which a sheet feeding unit can be readily replaced.

SUMMARY OF THE INVENTION

An image forming apparatus according to the present invention includes: a plurality of sheet storage portions that has a sheet stacking portion, which can be lifted and lowered and on which a sheet is stacked, the plurality of sheet storage portions being drawably provided in an apparatus main body; a sheet feeding portion that is disposed above each of the sheet storage portions and supplies and feeds the sheet stacked on the sheet stacking portion; a driving portion that lifts the sheet stacking portion in the sheet storage portion mounted in the apparatus main body to a position at which the sheet can be supplied and fed by the sheet feeding portion; a detecting portion that outputs a detection signal when the sheet storage portion is mounted at a mounting position inside of the apparatus main body; and a controller that controls the driving portion in such a manner as to lift the sheet stacking portion in the sheet storage portion based on the detection signal output from the detecting portion, wherein the controller, when one of adjacent sheet storage portions is mounted, controls the driving portion in such a manner as not to lift the sheet stacking portion in the one sheet storage portion based on the detection signal output from the detecting portion in the state in which the other sheet storage portion is drawn or detached.

Like the present invention, when the sheet storage portion nearest the sheet feeding portion of the sheet storage portion is drawn or detached, the sheet stacking portion for the mounted sheet storage portion is prevented from being lifted, so that the sheet feeding portion can be readily replaced.

Further features of the present invention will become apparent from the following description of exemplary embodiments (with reference to the attached drawings).

DETAILED DESCRIPTION OF THE PREFERRED EMBODIMENTS

Figure 1:
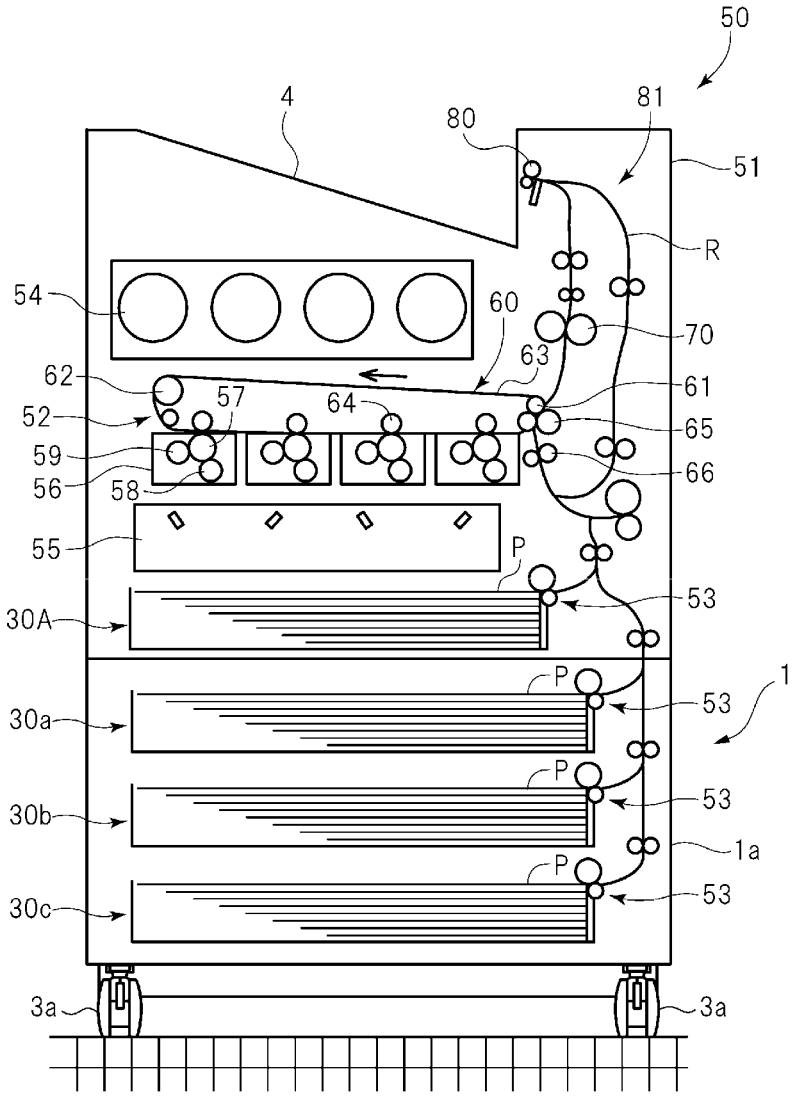
FIG. 1 is a view illustrating the schematic configuration of a full-color laser beam printer exemplifying an image forming apparatus according to an exemplary embodiment of the present invention.
Figure 2:
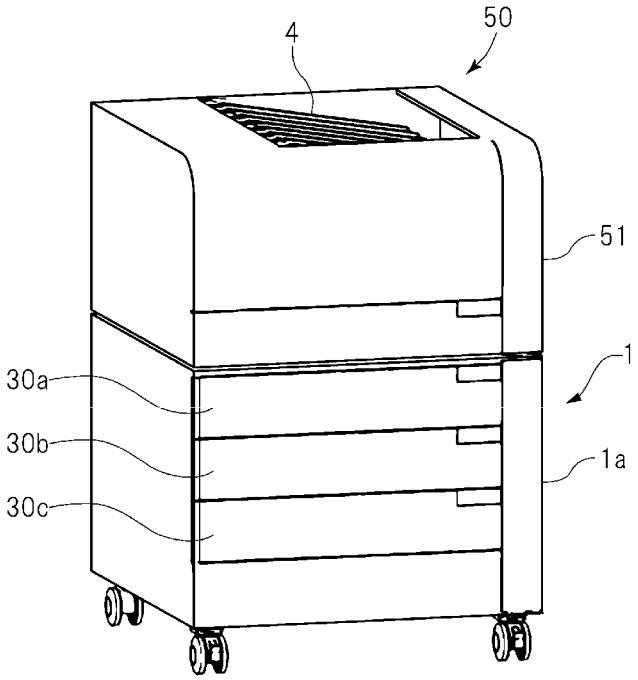
FIG. 2 is a perspective view illustrating the full-color laser beam printer.

A detailed description will be given below of an exemplary embodiment according to the present invention with reference to the attached drawings. FIG. 1 is a view illustrating the schematic configuration of a full-color laser beam printer exemplifying an image forming apparatus according to an exemplary embodiment of the present invention; and FIG. 2 is a perspective view illustrating the full-color laser beam printer.

In FIG. 1, a full-color laser beam printer 50 (hereinafter referred to as a printer) includes a printer main body 51 serving as the main body of an image forming apparatus (i.e., an image forming apparatus main body) and an image forming portion 52 for forming an image on a sheet. The image forming portion 52 is provided with a laser scanner 55, four process cartridges 56 for forming toner images of four colors, that is, yellow (Y), magenta (M), cyan (C), and black (K), an intermediate transfer unit 60, a fixing portion 70, and the like.

The intermediate transfer unit 60 includes: an intermediate transfer belt 63 stretched across a drive roller 61, a tension roller 62, and the like; and a primary transfer roller 64 that is disposed inside of the intermediate transfer belt 63 and abuts against the intermediate transfer belt 63 at a position facing a photosensitive drum 57. At a position facing the drive roller 61 at the intermediate transfer unit 60 is provided a secondary transfer roller 65 constituting a secondary transfer unit for transferring a color image formed on the intermediate transfer belt onto a sheet P. Moreover, the fixing portion 70 is disposed above the secondary transfer roller 65, and further, above the fixing portion 70 are disposed a pair 80 of discharge rollers and a double-sided reversing portion 81.

A sheet feeding cassette 30A on the side of the main body is detachably attached at the lower section of the printer main body 51. A sheet feeding device 1 detachably provided with a plurality of sheet feeding cassettes 30*a*, 30*b*, and 30*c*, that is, three in the present exemplary embodiment, is disposed at the lower section of the printer main body 51. Each of the printer main body 51 and the sheet feeding device 1 includes a sheet feeding portion 53 for feeding the sheet P stored in each of the sheet feeding cassette 30A on the side of the main body and the three sheet feeding cassettes 30*a*, 30*b*, and 30*c*.

Next, a description will be given of an image forming operation in the printer 50 such configured as described above. First, when image information is received from a personal computer or the like, not illustrated, the surface of the photosensitive drum in each of the process cartridges 56 is scanned with laser beams emitted from the laser scanner 55 according to image information on the yellow, magenta, cyan, and black component colors in the image forming portion 52. In this manner, the surface of the photosensitive drum 57 that is uniformly charged at a predetermined polarity and potential by a charger 58 is sequentially exposed to the laser beams, so that electrostatic latent images of the yellow, magenta, cyan, and black colors are sequentially formed on the photosensitive drum in each of the process cartridges 56.

Thereafter, the electrostatic latent images are developed into visible images with toners of the yellow, magenta, cyan, and black colors reserved in toner cartridges 54, respectively, by a development device 59. The toner image of each of the colors formed on each of the photosensitive drums is sequentially transferred in superposition on the intermediate transfer belt 63 by a primary transfer bias applied to the primary transfer roller 64. As a consequence, the toner images are formed on the intermediate transfer belt 63.

In parallel to this toner image forming operation, the sheet P stacked on the sheet feeding cassette 30A on the side of the main body or the sheet feeding cassette 30*a*, 30*b*, or 30*c* is fed out by the sheet feeding portion 53, and then, the fed sheet P is conveyed to a pair 66 of registration rollers. After that, the skew feeding of the sheet P is corrected by the pair 66 of registration rollers, and then, the sheet P is conveyed to a secondary transfer unit, at which the toner images are transferred onto the sheet P at a time by a secondary transfer bias applied to the secondary transfer roller 65.

Subsequently, the sheet P having the toner images transferred thereonto is conveyed to the fixing portion 70, at which the color toners are melted in mixture with the application of heat and pressure, so that the toner images are fixed onto the sheet P as a color image. Thereafter, the sheet P having the color image fixed thereonto is stacked on a stack tray 4 by the pair 80 of discharge rollers disposed downstream of the fixing portion 70.

Figure 3:
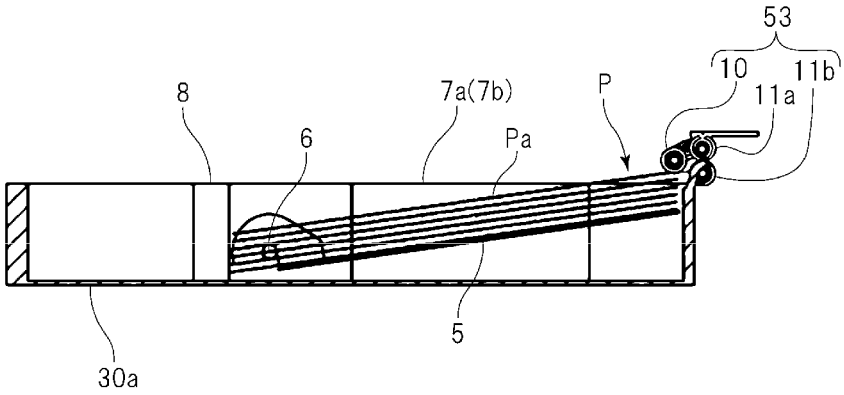
FIG. 3 is a view explanatory of the configuration of a sheet feeding device disposed in the full-color laser beam printer.

In the meantime, the sheet feeding device 1 is provided with the sheet feeding cassettes 30 (i.e., 30*a* to 30*c*) serving as the plurality of sheet storage units, as described already, in a drawable manner in a housing-like device main body 1*a*. A sheet supporting plate 5 serving as a sheet stacking unit, on which the sheet is stacked, is disposed in the sheet feeding cassette 30*a* in such a manner as to be pivotal (freely lifted and lowered) manner in a vertical direction on a shaft 6 as a fulcrum, as illustrated in FIG. 3. Moreover, the sheet feeding portion 53 is provided with a feeding roller 10 for feeding the sheet stored in the sheet feeding cassette 30*a* and a pair of separation rollers 11*a* and 11*b* for separating the sheets fed one by one by a feeding roller 10. The feeding roller 10 and the pair of separation rollers 11*a* and 11*b* constitute a sheet feeding unit.

Figure 4:
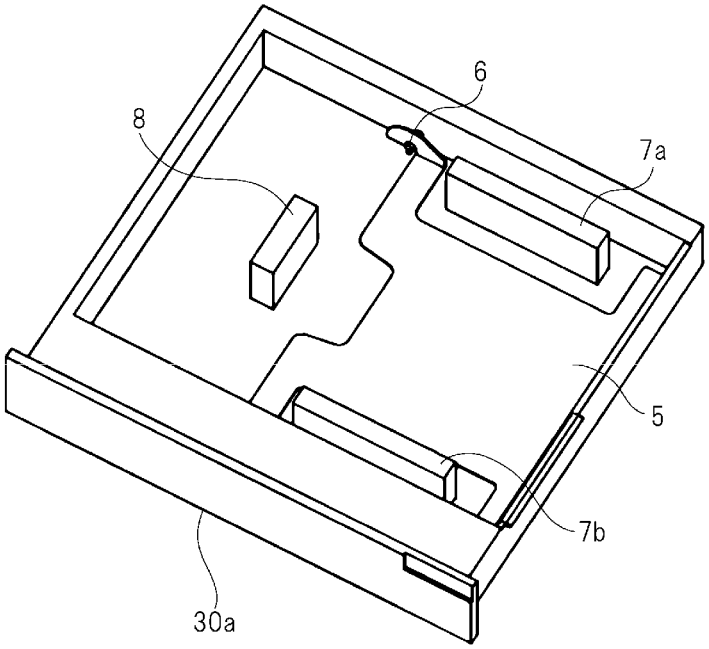
FIG. 4 is a view explanatory of the configuration of a sheet feeding cassette disposed in the sheet feeding device.

Additionally, the sheet feeding cassette 30*a* includes width restricting plates 7*a* and 7*b* that can be moved in a width direction perpendicular to a sheet feeding direction so as to restrict the position of the sheet to be stored, and a rear end restricting plate 8 that can be moved in the sheet feeding direction so as to restrict the rear end of the sheet, as illustrated in FIG. 4. When the sheet is replenished, the sheet feeding cassette 30*a* is drawn from the sheet feeding device 1, and then, the width restricting plates 7*a* and 7*b* and the rear end restricting plate 8 are positioned according to the size of the sheet to be stored. Thereafter, the sheet is stacked on the sheet supporting plate 5, and then, the sheet feeding cassette 30*a* is inserted into the device main body 1*a* of the sheet feeding device 1. Here, the sheet feeding cassettes 30*b* and 30*c* arranged under the sheet feeding cassette 30*a* also have the same configuration as that of the sheet feeding cassette 30*a*, and therefore, their description will be omitted.

Figure 5:
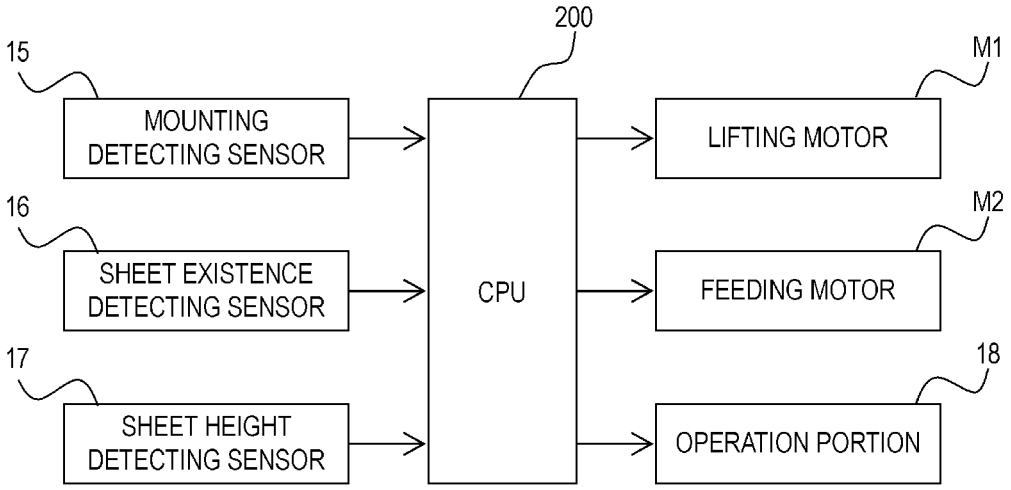
FIG. 5 is a control block diagram illustrating the full-color laser beam printer.

FIG. 5 is a control block diagram illustrating the full-color laser beam printer according to the present exemplary embodiment. In FIG. 5, a CPU 200 serves as a control unit. To the CPU 200 is connected a lifting motor M1 serving as a driving unit for lifting each of the sheet supporting plates 5 for the three sheet feeding cassettes 30*a*, 30*b*, and 30*c* up to a position at which the sheet can be supplied and fed by the feeding roller 10. Moreover, to the CPU 200 are connected a feeding motor M2 for driving the feeding roller 10 and the pair of separation rollers 11*a* and 11*b*, an operation portion 18 provided with a display (i.e., a monitor), not illustrated, and the like.

In addition, to the CPU 200 are connected a mounting detecting sensor 15 for generating a detection signal that allows the CPU 200 to detect whether or not the sheet feeding cassette 30 is mounted, and a sheet existence detecting sensor 16 for generating a detection signal that allows the CPU 200 to detect whether or not the sheet is present on the sheet supporting plate. Moreover, to the CPU 200 is connected a sheet height detecting sensor 17 for generating a detection signal that allows the CPU 200 to detect whether or not an uppermost sheet Pa out of the sheets P stacked on the sheet supporting plate reaches a position at which the sheet can be supplied and fed by the feeding roller 10.

In the present exemplary embodiment, a general sensor in which the movement of a detecting button or a detecting flag in abutment against the sheet feeding cassette or the sheet turns a photo interrupter on or off so as to generate a detection signal is used as each of the sensors. The mounting detecting sensor 15 outputs an ON signal when the sheet feeding cassette 30 is mounted whereas it outputs an OFF signal when the sheet feeding cassette 30 is drawn.

The sheet existence detecting sensor 16 outputs an ON signal in the case where the sheet is present on the sheet supporting plate whereas it outputs an OFF signal in the case where the sheet is absent on the sheet supporting plate. Moreover, the sheet height detecting sensor 17 outputs an ON signal in the case where the uppermost sheet Pa is in a predetermined height whereas it outputs an OFF signal in the case where the uppermost sheet Pa is positioned lower than the predetermined height.

Incidentally, the plurality of lifting motors M1 may be provided for lifting and driving the sheet supporting plate 5 for each of the sheet feeding cassettes 30*a* to 30*c*, or the single lifting motor M1 may selectively lift and drive the sheet supporting plate 5 via a clutch or the like. In the same manner, the plurality of feeding motors M2 may be provided for driving each of the sheet feeding portions 53, or the single feeding motor M2 may selectively drive each of the sheet feeding portions 53 via a clutch or the like. The mounting detecting sensor 15, the sheet existence detecting sensor 16, and the sheet height detecting sensor 17 are provided at each of the sheet feeding cassettes 30*a* to 30*c*.

When the sheet feeding cassette 30 is mounted at a mounting position inside of the device main body, at which the sheet can be supplied and fed in the sheet feeding device 1, the mounting detecting sensor 15 outputs the detection signal (i.e., the ON signal). In response to the detection signal, the CPU 200 drives the lifting motor M1 so as to lift the sheet supporting plate 5. As illustrated in FIG. 3, when the sheet supporting plate 5 is lifted, the CPU 200 stops the drive of the lifting motor M1 based on the detection signal (i.e., the ON signal) output from the sheet height detecting sensor 17. At this time, the uppermost sheet Pa out of the sheets P stacked on the sheet supporting plate 5 is located at a position at which the sheet can be supplied and fed by the feeding roller 10. Thereafter, when the operation portion 18 selects any one of the sheet feeding cassettes 30*a* to 30*c*, the CPU 200 drives the feeding motor M2 so as to rotate the feeding roller 10 and the pair of separation rollers 11*a* and 11*b* positioned above the selected sheet feeding cassette. In this manner, the sheet can be supplied and fed from the selected one out of the sheet feeding cassettes 30*a* to 30*c*.

Incidentally, when the sheets are supplied and fed so that no sheet is present on the sheet supporting plate 5, the CPU 200 allows the operation portion 18 to display the absence of the sheet on the display based on the detection signal (i.e., the OFF signal) output from the sheet existence detecting sensor 16. A user draws the sheet feeding cassette 30 having no sheet stacked thereon from the sheet feeding device 1 according to the display so as to replenish sheets. Here, the sheet supporting plate 5 is normally in the lifted state immediately before the sheet feeding cassette 30 is drawn when the sheet feeding cassette 30 is drawn. Therefore, when the sheet feeding cassette 30 is drawn, the sheet feeding cassette 30 is disconnected from the lifting motor M1, so that the sheet supporting plate 5 is lowered. When the sheet supporting plate 5 is lowered, sheets can be easily stored in the sheet feeding cassette 30.

In the meantime, the feeding roller 10 is degraded due to abrasion or the like, thereby causing the deterioration of sheet feeding performance. In view of this, the feeding roller 10 is replaced periodically or in the case where the abrasion amount of the feeding roller 10 becomes large. In the present exemplary embodiment, the sheet feeding cassette 30 can be drawn from the sheet feeding device 1, and further, can be detached therefrom. When sheets are replenished, the sheet feeding cassette 30 is drawn on the way, and then, the sheets are replenished. When the feeding roller 10 is replaced, the sheet feeding cassette 30 is completely drawn from the sheet feeding device 1, and then, the feeding roller 10 is replaced. Here, according to the configuration of the device, when the sheet feeding cassette 30 is drawn on the way, a hand may reach the feeding roller 10. In this case, the sheet feeding cassette 30 need not be detached.

Next, a description will be given of the case where the feeding roller 10 is replaced. The feeding roller 10 is replaced by utilizing a mounting space for the sheet feeding cassette adjacent thereto. Specifically, the other sheet feeding cassette disposed above one out of the sheet feeding cassettes, on which the sheet is supplied and fed by the feeding roller, is drawn, so that the feeding roller 10 is replaced by utilizing a mounting space for the other sheet feeding cassette.

Figure 6:
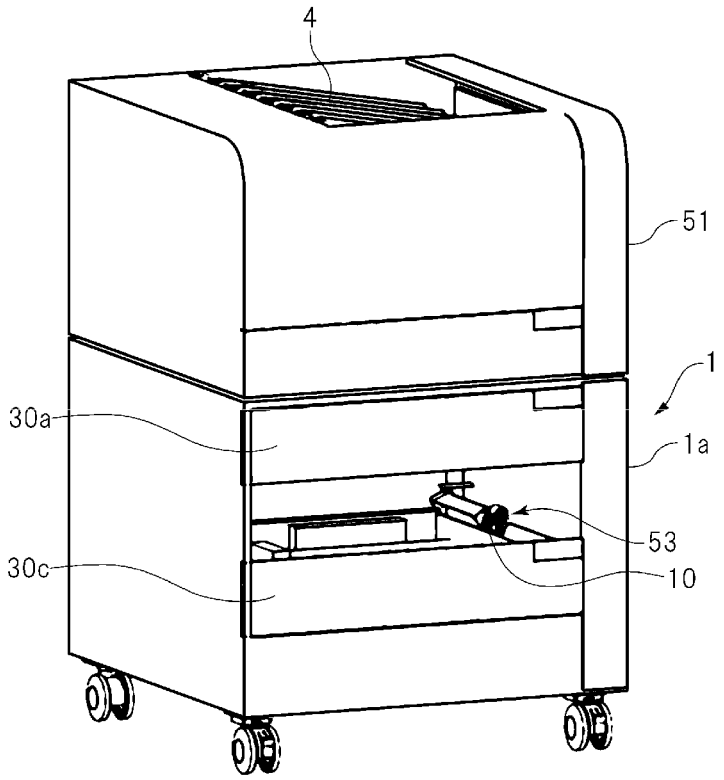
FIG. 6 is a view illustrating a state in which the sheet feeding cassette immediately above a lowermost sheet feeding cassette in the sheet feeding device is detached from the sheet feeding device.

For example, when the lowermost feeding roller 10 is replaced, the sheet feeding cassette 30*b* right above the lowermost sheet feeding cassette 30*c* is detached from the device main body 1*a* of the sheet feeding device 1, as illustrated in FIG. 6. Next, the lowermost sheet feeding cassette 30*c* is once drawn from the device main body 1*a* of the sheet feeding device 1, and thereafter, the sheet feeding cassette 30*c* is pushed in to be returned to the original mounting position. In this manner, the lowermost sheet feeding cassette 30*c* is slightly drawn, so that the sheet supporting plate 5 and the lifting motor M1 are disconnected from each other, thus lowering the sheet supporting plate 5.

And then, even if the lowermost sheet feeding cassette 30*c* is mounted again in the device main body 1*a*, the sheet supporting plate 5 is kept at the lowered position. In other words, the sheet feeding cassette 30*c* is drawn or inserted by slight amount, the sheet supporting plate 5 can be located at the lower position. Here, "the sheet feeding cassette right above" signifies the upper sheet feeding cassette disposed adjacently in the vertical direction without any sheet feeding cassettes interposed between the lower sheet feeding cassette and the same.

When the lowermost sheet feeding cassette 30*c* returns to the mounting position, the mounting detecting sensor 15 detects the return. Normally, the CPU 200 drives the lifting motor M1 based on the detection signal output from the mounting detecting sensor 15, so as to lift the sheet supporting plate 5. However, the control for replacing the feeding roller is different from the above-described control. Specifically, in the case where the sheet feeding cassette 30*c* disposed right under the sheet feeding cassette 30*b* is drawn or inserted in the state in which the sheet feeding cassette 30*b* is kept detached, the CPU 200 does not drive the lifting motor M1 even if the CPU 200 detects that the sheet feeding cassette 30*c* is mounted based on the detection signal output from the mounting detecting sensor 15.

Consequently, even if the lowermost sheet feeding cassette 30*c* returns to the mounting position, the sheet supporting plate 5 is not lifted, and therefore, the feeding roller 10 to be replaced cannot be brought into contact with the sheet stacked on the sheet supporting plate 5. Moreover, since the sheet feeding cassette 30*b* nearest and right above the sheet feeding cassette 30*c* is detached, the upper section of the feeding roller 10 to be replaced is released, thereby securing the visibility of a portion to be replaced.

Figure 7:
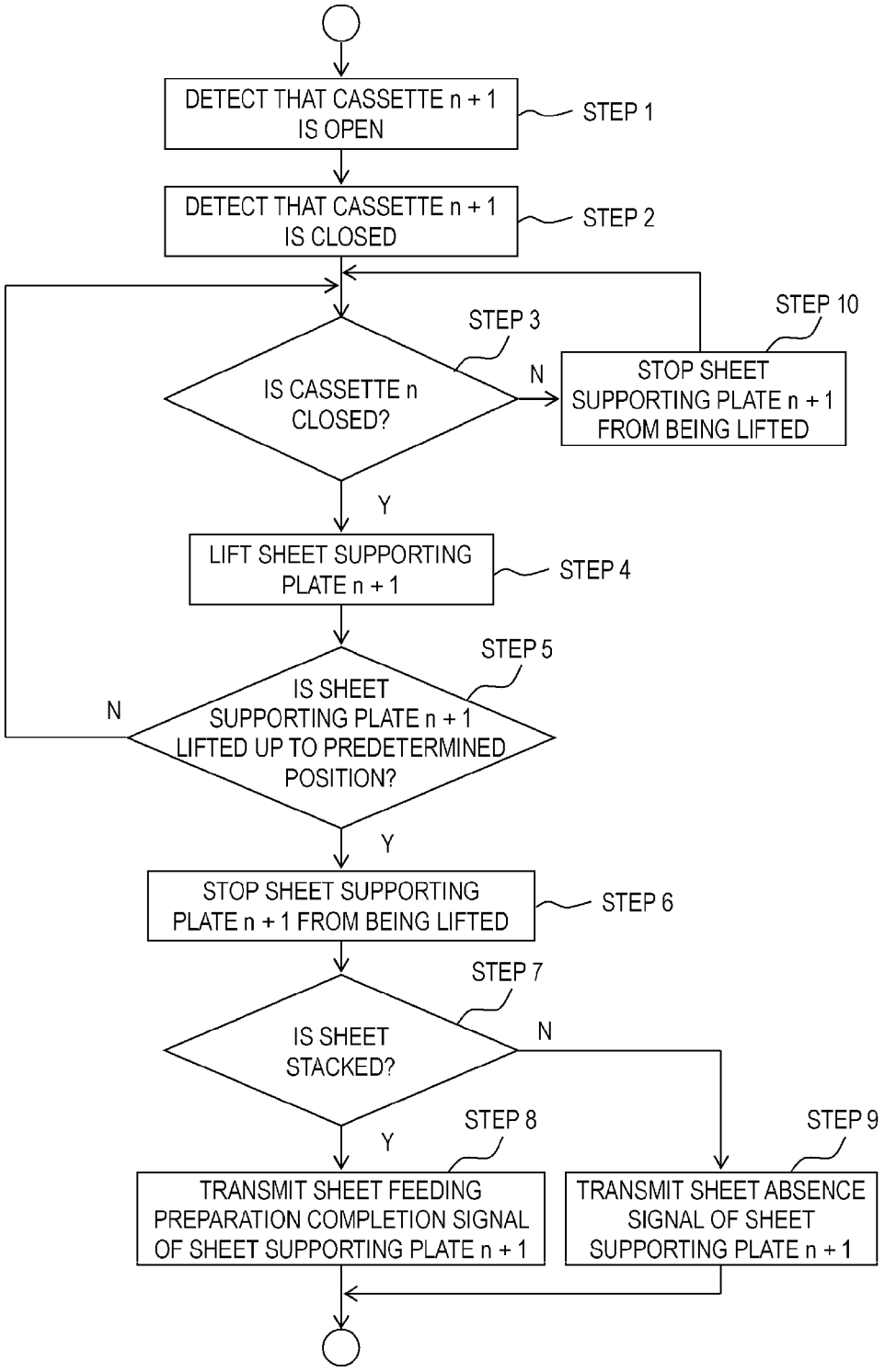
FIG. 7 is a flowchart illustrating a sheet feeding operation by the sheet feeding device and a control operation at the time of the replacement of a feeding roller.

Subsequently, a sheet feeding operation and a control operation when the feeding roller 10 is replaced according to the above-described exemplary embodiment will be described with reference to a flowchart of FIG. 7. In FIG. 7, a cassette n+1 is disposed right under a cassette n. Therefore, in the present exemplary embodiment, the cassette n represents the cassette 30*b* serving as a second sheet storage unit whereas the cassette n+1 represents the cassette 30*c* serving as a first sheet storage unit. In addition, the sheet supporting plate n+1 serves as a first sheet stack unit for the sheet feeding cassette 30*c*.

First, in the case where the feeding roller 10 in the cassette n+1 (i.e., the lowermost sheet feeding cassette 30*c*) is replaced, the cassette n (i.e., the sheet feeding cassette 30*b*) right above the cassette n+1 is detached, as illustrated in FIG. 6. Next, the cassette n+1 is drawn and pushed in. The CPU 200 detects that the cassette n+1 is open, that is, the cassette n+1 is drawn based on the detection signal (i.e., the OFF signal) output from the mounting detecting sensor 15 serving as a first detecting unit (STEP 1).

Thereafter, the CPU 200 detects that the cassette n+1 is closed, that is, the cassette n+1 is mounted based on the detection signal (i.e., the ON signal) output from the mounting detecting sensor 15 (STEP 2). Here, the matter (closure) that the cassette is closed signifies that the cassette is housed inside of the device main body 1*a* whereas the matter (open) that the cassette is open signifies that the cassette is drawn or detached from the device main body 1*a*.

Subsequently, the CPU 200 confirms whether or not the cassette n (i.e., the cassette 30*b*) is closed based on the detection signal (i.e., the ON signal) output from the mounting detecting sensor 15 serving as a second detecting unit (STEP 3). Normally, since the cassette n (i.e., the cassette 3*b*) is closed (Y in STEP 3), the CPU 200 drives the lifting motor M1 so as to lift the sheet supporting plate n+1 in the cassette n+1 (STEP 4).

The CPU 200 drives the lifting motor M1 until it detects that the uppermost sheet Pa on the sheet supporting plate n+1 is lifted up to a predetermined position at which the sheet can be supplied and fed by the feeding roller 10 serving as the first sheet feeding unit in response to the detection signal output from the sheet height detecting sensor 17. Thereafter, when the CPU 200 detects that the uppermost sheet Pa is lifted to the predetermined position at which the sheet can be supplied and fed by the feeding roller 10 (Y in STEP 5), the CPU 200 stops the driving of the lifting motor M1. In this manner, the sheet supporting plate n+1 is stopped from being lifted (STEP 6).

Next, the CPU 200 detects whether or not the sheet is stacked on the sheet supporting plate n+1 based on the detection signal output from the sheet existence detecting sensor 16 (STEP 7). In the case where the CPU 200 detects that the sheet is stacked on the sheet supporting plate n+1 (Y in STEP 7), the CPU 200 transmits a sheet feeding preparation completion signal of the sheet supporting plate n+1 to the operation portion 18 (STEP 8), thereby displaying sheet feeding preparation completion on the display. In contrast, in the case where the CPU 200 detects that no sheet is stacked on the sheet supporting plate n+1 (N in STEP 7), the CPU 200 transmits a sheet absence signal of the sheet supporting plate n+1 to the operation portion 18 (STEP 9), thereby displaying "no sheet" on the display.

On the other hand, in the case where the cassette n (i.e., the cassette 3*b*) is not closed (N in STEP 3), even if the mounting detecting sensor 15 detects the mounting of the cassette n+1, no initial lifting control is performed in STEP 3 to STEP 6, thus stopping the sheet supporting plate n+1 from being lifted (STEP 10). As a consequence, even if the cassette n+1 is mounted, the sheet supporting plate n+1 is kept lowered, so that the feeding roller 10 to be replaced cannot be brought into contact with the sheet on the sheet supporting plate n+1.

Moreover, since the right above cassette n is detached, a released space is defined above the feeding roller 10 to be replaced. The feeding roller can be visually recognized through the space, and further, the feeding roller can be replaced when a hand is inserted. Incidentally, when the cassette n is returned after the feeding roller is replaced, the initial lifting control in STEP 3 to STEP 6, described already, is started so as to lift the sheet supporting plate n+1 in the cassette n+1, thus preparing for a sheet feeding operation. In addition, when the cassette n is returned, the sheet supporting plate serving as the second sheet stacking unit for the cassette n also is lifted in the same manner, so that the uppermost sheet on the sheet supporting plate is lifted up to the position at which the sheet can be supplied and fed by the feeding roller serving as the second sheet feeding unit.

As described above, in the case where it is detected that the sheet feeding cassette right above (the feeding roller 10 of) the mounted sheet feeding cassette is detached, the sheet supporting plate for the mounted sheet feeding cassette is not lifted in the present exemplary embodiment. That is to say, the sheet feeding cassette corresponding to the feeding roller to be replaced is detached or inserted so as to lower the sheet supporting plate, before the sheet supporting plate is stopped from being lifted in the present exemplary embodiment.

In other words, when the first sheet storage unit is mounted, in the case of the input of the detection signal indicating that the second sheet storage unit disposed above is drawn or detached, the sheet stacking unit for the first sheet storage unit is controlled in such a manner as not to be lifted. In this manner, the space can be secured in the vicinity of the feeding roller in the state in which the feeding roller and the sheet do not abut against each other, resulting in enhancing the visibility and workability of the feeding roller to be replaced, so as to facilitate the replacement of the feeding roller.

Incidentally, although the description has been given of the replacement of the feeding roller in the present exemplary embodiment, at least one of the pair of separation rollers 11*a* and 11*b* constituting the sheet feeding unit may be replaced. That is to say, at least one of the feeding roller 10 and the pair of separation rollers 11*a* and 11*b* may be replaced.

Moreover, although the description has been given of the plurality of sheet feeding cassettes superposed in the vertical direction in the present exemplary embodiment, the present invention is not limited to this. For example, also in the case where the plurality of sheet feeding cassettes is arranged in a lateral direction, the sheet supporting plate for the mounted sheet feeding cassette is prevented from being lifted in the state in which the right and left sheet feeding cassettes nearest the feeding roller are detached, thus producing similar effects.

Additionally, although the description has been given of the case where the plurality of sheet feeding cassettes is provided in the sheet feeding device 1 independently of the printer main body 51 in the present exemplary embodiment, a plurality of sheet feeding cassettes may be provided in the printer main body 51, thus producing similar effects.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-151521 filed on Jul. 22, 2013, which is hereby incorporated by reference herein in its entirety.

What is claimed is:

1. A sheet feeding apparatus configured to feed a sheet to an image forming unit, comprising:

a frame of the sheet feeding apparatus;

a first sheet storage unit including a first sheet stacking portion on which a sheet is stacked, the first sheet storage unit being drawable with respect to the frame;

a second sheet storage unit including a second sheet stacking portion on which a sheet is stacked, the second sheet storage portion being drawable with respect to the frame and being disposed above the first sheet storage unit;

a first sheet feeding unit configured to feed the sheet stacked on the first sheet stacking portion;

a second sheet feeding unit configured to feed the sheet stacked on the second sheet stacking portion;

a first lift unit configured to lift the first stacking portion;

a first detecting unit configured to detect that the first sheet storage unit is mounted at a first position on the frame;

a second detecting unit configured to detect that the second sheet storage unit is mounted at a second position on the frame;

a first conveyance path provided in the frame and configured to guide the sheet fed by the first feeding unit to the image forming unit;

a second conveyance path provided in the frame and configured to guide the sheet fed by the second feeding unit to the image forming unit;

a controller configured to control the first lift unit, wherein the controller controls the first lift unit such that the first lift unit restricts lifting of the first stacking portion in a case where the first detecting unit detects that the first sheet storage unit is mounted at the first position on the frame in a state that the second detecting unit does not detect that the second sheet storage unit is mounted at the second position on the frame, and wherein the first sheet feeding unit includes a roller, the roller being at a position where detaching of the roller from the frame is allowable in a state that the second storage unit is drawn from the second position with respect to the frame, and detaching of the roller from the frame is allowable through a space formed by the second storage unit being drawn from the second position with respect to the frame.

2. The sheet feeding apparatus according to claim 1, wherein the controller controls the first lift unit such that the first lift unit lifts the sheet stacking portion in accordance with the second detection unit detecting that the second sheet storage unit is mounted on the second position on the frame in a state that the lifting of the first stacking portion has been restricted.

3. The sheet feeding apparatus according to claim 1, wherein the first sheet storage unit is drawable with respect to the frame in a direction perpendicular to a direction in which the sheet is fed by the first sheet feeding unit and the second sheet storage unit is drawable with respect to the frame in a direction perpendicular to a direction in which the sheet is fed by the second sheet feeding unit.

4. The sheet feeding apparatus according to claim 1, wherein the first sheet storage unit and the second sheet storage unit are vertically arranged.

5. The sheet feeding apparatus according to claim 1, wherein the second sheet storage unit is disposed immediately above the first sheet storage unit.

6. The sheet feeding apparatus according to claim 1, wherein the controller controls the first lift unit such that the first lift unit does not lift the first sheet stacking portion in a case where the first detecting unit detects that the first sheet storage unit is mounted on the first position on the frame in a state that the second detecting unit does not detect that the second sheet storage unit is mounted on the second position on the frame.

7. The sheet feeding apparatus according to claim 1, wherein the second sheet stacking portion lowers in accordance with the second sheet storage unit being drawn from the second position.

8. The sheet feeding apparatus according to claim 1, further comprising a second lift unit configured to lift the second stacking portion, wherein the controller controls the second lift unit.

9. The sheet feeding apparatus according to claim 8, wherein the first lift unit and the second lift unit include at least one driving source.

10. The sheet feeding apparatus according to claim 8, wherein the first lift unit lifts the first sheet stacking portion to a position where the sheet can be fed by the first sheet feeding unit and the second lift unit lifts the second sheet stacking portion to a position where the sheet can be fed by the second sheet feeding unit.

11. The sheet feeding apparatus according to claim 1, wherein the second conveyance path guides the sheet fed by the second sheet feeding unit to the first conveyance path.

12. The sheet feeding apparatus according to claim 1, wherein the controller controls the first lift unit such that the first lift unit lifts the first stacking portion in a case where the first detecting unit detects that the first sheet storage unit is mounted at the first position on the frame in a state that the second detecting unit detects that the second sheet storage unit is mounted at the second position on the frame, and wherein the controller controls the first lift unit such that the first lift unit restricts lifting of the first stacking portion in a case where the first detecting unit detects that the first sheet storage unit is mounted at the first position on the frame in a state that the second detecting unit does not detect that the second sheet storage unit is mounted on the second position on the frame.

13. A sheet feeding apparatus configured to feed a sheet to an image forming unit comprising:

a frame of the sheet feeding apparatus;

a first sheet storage unit including a first sheet stacking portion on which a sheet is stacked, the first sheet storage unit being drawable from a first position with respect to the frame;

a second sheet storage unit including a second sheet stacking portion on which a sheet is stacked, the second sheet storage unit being drawable from a second position with respect to the frame and disposed above the first sheet storage unit;

a first sheet feeding unit configured to feed the sheet stacked on the first sheet stacking portion;

a second sheet feeding unit configured to feed the sheet stacked on the second sheet stacking portion;

a first lift unit configured to lift the first stacking portion; and a controller configured to control the first lift unit, wherein the first sheet feeding unit includes a roller positioned at a position where detaching of the roller from the frame is allowable in a state that the second storage unit is drawn from the second position with respect to the frame, wherein the controller controls the first lift unit such that the first lift unit restricts lifting of the first stacking portion in a case where the first sheet storage unit is mounted at the first position on the frame in a state that the second sheet storage unit is not mounted at the second position on the frame, and wherein detaching of the roller from the frame is allowable through a space formed by the second sheet storage unit being drawn from the second position with respect to the frame.

14. The sheet feeding apparatus according to claim 13, wherein the first sheet storage unit is drawable with respect to the frame in a direction perpendicular to a direction in which the sheet is fed by the first sheet feeding unit and the second sheet storage unit is drawable with respect to the frame in a direction perpendicular to a direction in which the sheet is fed by the second sheet feeding unit.

15. The sheet feeding apparatus according to claim 13, wherein the first sheet storage unit and the second sheet storage unit are vertically arranged.

16. The sheet feeding apparatus according to claim 13, wherein the second sheet storage unit is disposed immediately above the first sheet storage unit.

17. The sheet feeding apparatus according to claim 13, wherein the second sheet stacking portion lowers in accordance with the second sheet storage unit being drawn from the second position.

18. The sheet feeding apparatus according to claim 13, further comprising a second lift unit configured to lift the first sheet stacking portion, wherein the controller controls the second lift unit.

19. The sheet feeding apparatus according to claim 18, wherein the first lift unit and the second lift unit include at least one driving source.

20. The sheet feeding apparatus according to claim 18, wherein the first lift unit lifts the first sheet stacking portion at a position where the sheet can be fed by the first sheet feeding unit and the second lift unit lifts the second sheet stacking portion at a position where the sheet can be fed by the second sheet feeding unit.

21. The sheet feeding apparatus according to claim 13, further comprising a first conveyance path provided in the frame and configured to guide the sheet fed by the first feeding unit to the image forming unit;

a second conveyance path provided in the frame and configured to guide the sheet fed by the second feeding unit to the image forming unit.

22. The sheet feeding apparatus according to claim 21, wherein the second conveyance path guides the sheet fed by the second feeding unit to the first conveyance path.

23. The sheet feeding apparatus according to claim 13, further comprising a first detecting unit configured to detect that the first sheet storage unit is mounted on the first position on the frame; and a second detecting unit configured to detect that the second sheet storage unit is mounted on the second position on the frame.

24. The sheet feeding apparatus according to claim 23, wherein the controller controls the first lift unit such that the first lift unit does not lift the first stacking portion in a case where the first detecting unit detects that the first sheet storage unit is mounted on the first position of the apparatus main body in a state that the second detecting unit does not detect that the second sheet storage unit is mounted on the second position of the apparatus main body.

25. The sheet feeding apparatus according to claim 23, wherein the controller controls the first lift unit such that the lift unit lifts the sheet stacking portion in accordance with the second detection unit detecting that the second sheet storage unit is being mounted at the second position on the frame in a state that the lifting of the first stacking portion has been restricted.

* * * * *